United States Patent [19]

Crasnianski

[11] 4,077,240

[45] Mar. 7, 1978

[54] CYLINDER LOCK

[75] Inventor: Serge Crasnianski, Grenoble, France

[73] Assignee: I S A S.a.r.l., Haguenau, France

[21] Appl. No.: 723,075

[22] Filed: Sep. 14, 1976

[30] Foreign Application Priority Data

Sep. 23, 1975 France ..... 75 29046

[51] Int. Cl.[2] ..... E05B 29/02

[52] U.S. Cl. ..... 70/360; 70/377

[58] Field of Search ..... 70/360, 362, 364 R, 70/365, 366, 376, 377

[56] References Cited

U.S. PATENT DOCUMENTS

| | | | |
|---|---|---|---|
| 816,705 | 4/1906 | Booth | 70/377 X |
| 1,823,411 | 9/1931 | Schori | 70/377 X |

FOREIGN PATENT DOCUMENTS

| | | | |
|---|---|---|---|
| 820,551 | 11/1951 | Germany | 70/360 |

*Primary Examiner*—Robert L. Wolfe

*Attorney, Agent, or Firm*—Flynn & Frishauf

[57] ABSTRACT

The invention relates to a cylindrical lock having a stator with a rotor in said stator having lamellae actuated by a flat key.

The rotor comprises floating lamellae capable of moving freely, but to a limited extent, both radially and angularly, and means for guiding the flat key over its entire introduction path into the rotor without any possibility of lateral and radial displacement, this key comprising complementary profiles along its two edges and a tapered end with convex surfaces.

10 Claims, 8 Drawing Figures

FIG.3
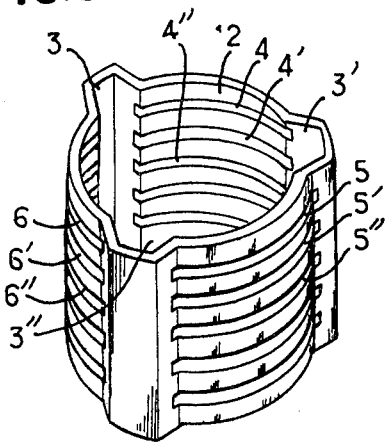
FIG.5
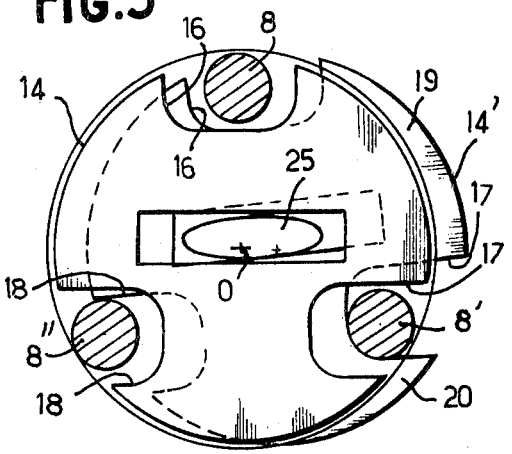
FIG.4
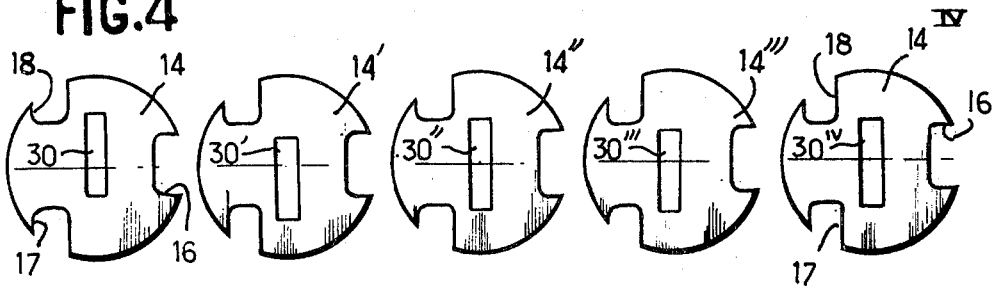
FIG.6
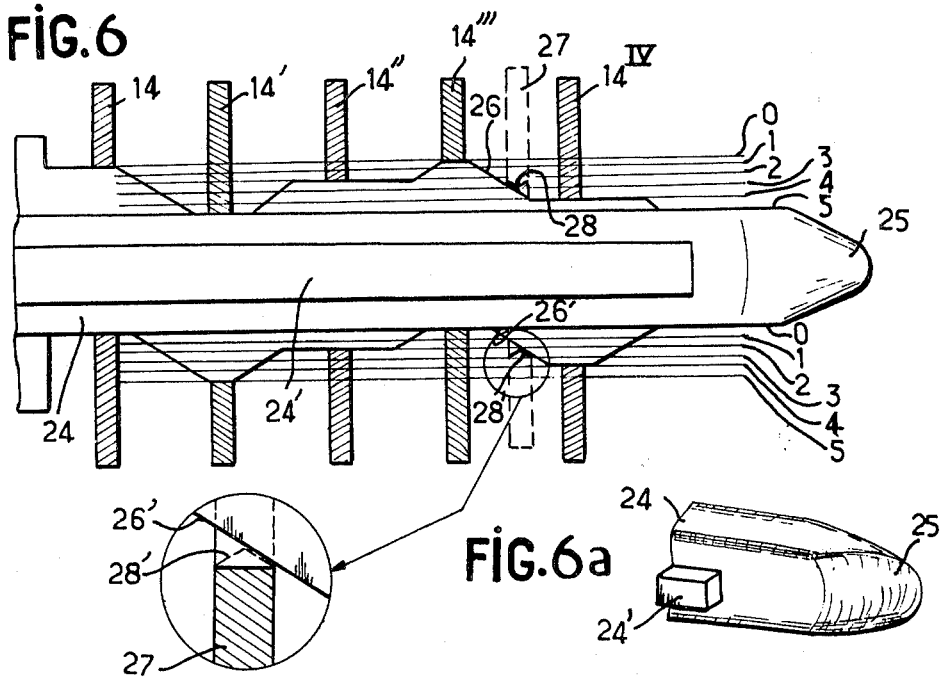
FIG.6a

CYLINDER LOCK

FIELD OF THE INVENTION

This invention relates to a cylinder lock or safety block of the type formed by a stator with a cylindrical bore in which is mounted a rotor comprising, on the one hand, locking elements which, in the rest position, prevent the rotor from rotating and, on the other hand, locking elements formed by thin plates, so-called lamellae, disposed perpendicularly of the axis of the rotor and displaceable in at least one direction so as to engage, when the lock is in its rest position, in grooves or slots formed in the inner surface of the stator. These lamellae comprise central openings which are staggered relative to one another in a diametral direction, the positions of these openings in the successive lamellae being dependent upon the profile of the key so that the introduction of the key into the rotor results in the alignment of the lamellae and their disengagement from the slots in the stator and, by an axial pressure applied to the rotor, enables its locking elements to be released for rotation whilst, at the same time, turning the rotor to actuate the lock by means of a control member, such as a cam, integral with the inner end of the rotor.

BACKGROUND OF THE INVENTION

In conventional cylinder locks of this type, the lamellae are guided in a diametral direction in transverse keyways formed in the rotor and are each provided with a return spring under the action of which they engage in the slots of the stator when the key is removed.

On the other hand, it has been proposed to make the lamellae in the form of discs which are not provided with return springs and of which the movements along two diameters at right angles to one another are guided by ball races formed in transverse dividing webs between which the lamellae amounted and which are integral with one another to form the rotor of the cylinder, this double movement of the lamellae being obtained by means of a cruciform key by way of four additional balls situated between the lamellae and each notch of the key.

The advantage of locks with lamellae displaceable in two directions at right angles to one another is that they have a large number of combinations which is dependent upon the number of lamellae and upon the number of notches in the two profiles of the cruciform key, which provides this lock with a high level of potential security. By contrast, the production and assembly of cylinders with lamellae displaceable in two directions are so complex that no practical embodiment has as yet been developed. In addition, the cruciform keys are not readily accepted for certain applications, in particular for safety locks for motor vehicles (door locks and antitheft locks), so that their use has been virtually confined to certain door locks.

OBJECT OF THE INVENTION

The object of the present invention is to obviate the disadvantages of the two types of known cylinder locks referred to above and to provide cylinder locks which are much simpler in construction whilst, at the same time, retaining a sufficiently large number of combinations, as well as the advantage of using flat keys.

SUMMARY OF THE INVENTION

The cylinder lock of the general type defined above, which is the subject of the invention, is distinguished by the fact that it comprises floating lamellae mounted in such a way that they are able to move freely, but to a limited extent, both radially and angularly so that, in the rest position, they occupy positions which are radially and angularly offset relative to one another, and by the fact that the rotor comprises means for guiding the flat key over its entire introduction path into the cylinder without any possibility of radial or lateral displacement, this key comprising complementary profiles on its two opposite edges and a tapered end with convex surfaces enabling it to be introduced into the misaligned and angularly offset openings of the lamellae in order to unlock them and also to return them to the initial locking position by removal of the key.

DESCRIPTION OF THE DRAWINGS

One embodiment of the lock according to the invention is described by way of example in the following and illustrated on a greatly enlarged scale in the accompanying drawing, wherein:

FIG. 3 is a perspective view of part of the stator.

FIG. 4 is a plan view showing the successive lamellae with their slots radially offset relative to one another.

FIG. 5 shows the two successive positions of a lamella before and after introduction of the key.

FIG. 6 shows the flat key which may be used with the lock shown in FIGS. 1 to 5.

FIG. 6*a* shows a prespective view of the end of the key.

DESCRIPTION OF SPECIFIC EMBODIMENTS

Figure 1:
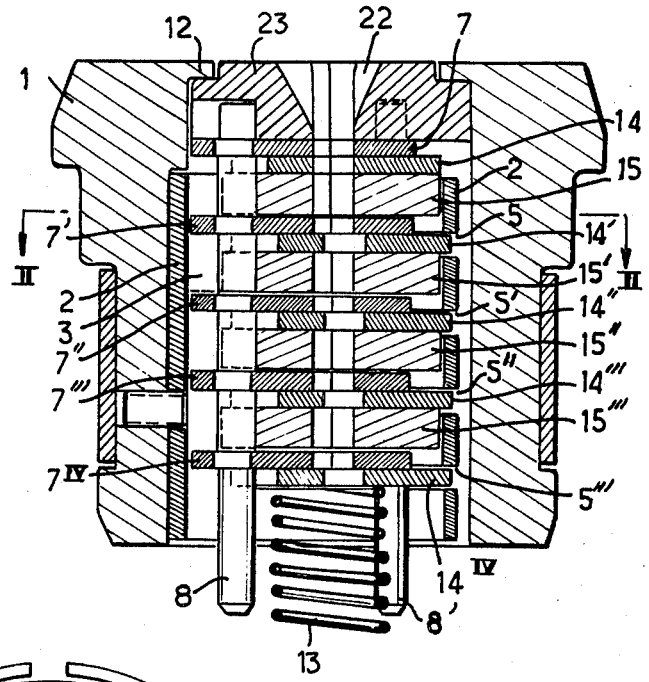
FIG. 1 is an axial section through the lock according to the invention.
Figure 2:
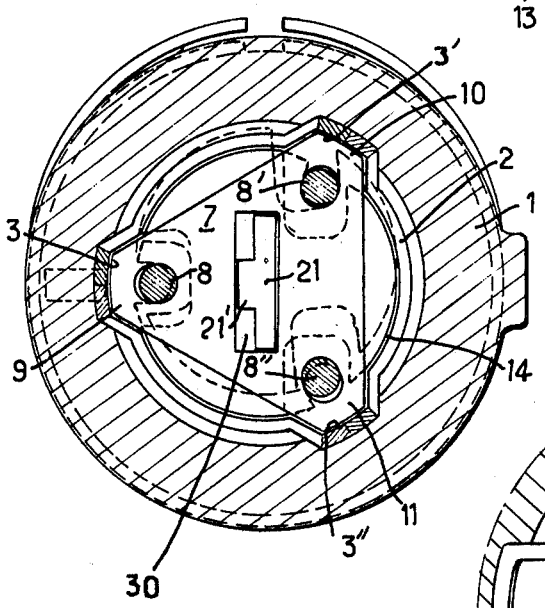
FIG. 2 is a cross-section on the line II—II of FIG. 1.

As shown in FIGS. 1, 2 and 3, the barrel of the cylindrical lock is formed by a cylindrical stator 1 in the bore of which there is fitted a cage 2 of generally cylindrical shape, but comprising internally three recesses 3, 3', 3'' extending over its entire height at angles of 120° from one another, and several series of three grooves or slots 4, 5, 6 - 4', 5', 6' - 4'', 5'', 6'' . . . distributed at regular intervals over the height of the cage and formed in each series between the recesses 3, 3', 3''.

This cage may be made in the form of an open sleeve or tube from a sheet of metal which has been rolled, bent, cut and joined by rolling, or in three equal parts welded to one another as shown in FIG. 2.

The rotor mounted in this cage is formed by several thin plates 7, 7', 7'' equal in number to the series of slots and joined by three pins 8, 8', 8'', the latter having undergone for example incipient shearing to cause lateral staggering of the corresponding sections visible in FIG. 2 and the thin plates being crimped onto these staggered sections by a centripetal pressure applied by a suitable tool to their corresponding outer semiperiphery. To this end, the pins 8 are made of a softer material than the thin plates 7. As shown in FIG. 2, the thin plates 7 comprise three projections or locking lugs 9, 10, 11 which are accommodated in recesses of the same shape formed by the indentations 3, 3', 3'' of the cage 2, preventing any rotation of the rotor. The upper part of the stator has an inner shoulder 12 which prevents the rotor from being axially displaced towards the outside, a compression spring 13, which acts on the inner end of the rotor, tending to apply it against said shoulder.

The pins are extended beyond the inner end of the cage to form the control member for the lock bolt.

The slots such as 4, 5, 6 of the cage 2 are substantially equal in height to the thickness of the thin plates 7 so as to enable the thin plates 7 to engage therein with minimal play after the axial displacement and rotation of the rotor, as will be explained hereinafter.

Below each locking plate 7, 7', 7'' there is a lamella 14, 14', 14'' in disc form which is supported by the underlying thin plate by way of a crosspiece 15, 15', 15'' which limits the play of the lamellae. The rotor is thus formed by several stages each comprising a thin plate 7, a lamella 14 and a crosspiece 15, the lamellae being situated at the level of the slots 4, 5, 6 - 4', 5', 6' . . . of the cage when the lock is in its rest position.

As shown in FIG. 5, each lamella comprises three slots 16, 17, 18 for the passage of the three pins 8, 8', 8'', these slots having a sufficient depth and width to allow the lamellae to be displaced on the one hand radially and, on the other hand, angularly. FIG. 5 shows a lamella 14 in a position in which it is centred relative to the axis 0 of the rotor and, hence, engaged in the slots 4, 5, 6 and a lamella 14' of a lower stage 7' which has undergone a double radial and angular displacement and which is engaged at a part of its periphery, at 19 and 20, in two slots of the cage 2.

All the thin plates 7, 7', 7'' have a central opening 21 identical in shape and position corresponding to the opening 22 in the upper part 23 of the rotor, these openings being intended to receive and guide the flat key which will be described hereinafter with reference to FIG. 6. In order to prevent any radial and lateral displacement of the key, the openings 21 in the thin plates have a lateral widening 21' of which the profile corresponds to that of a lateral rib 24' provided on a lateral surface of the key 24 (FIG. 6). This arrangement may also be reversed. By contrast, as shown in FIG. 4, the lamellae 14 comprise rectangular openings 30 of which the height also corresponds to that of the key and of which the width corresponds to the maximum thickness of the key at the rib 24', but which are diametrically staggered relative to one another in accordance with the upper and lower parts of the profiles of the key when it is introduced into the rotor, so that the introduction of the key causes a radial and angular realignment of all the lamellae, i.e. their centring relative to the axis of the rotor by disengaging them from the slots 4, 5, 6 of each stage.

FIG. 6 shows the shank 24 of the key intended to be used with the lock according to the invention. FIG. 6 also shows the lamellae 14 to $14^{IV}$ in their centred positions following introduction of the key and disengagement from the slots 4, 5, 6 of the cage of the stator which has not been shown in this Figure in the interests of clarity. It can be seen from FIG. 6*a*, which shows the free end of the key 24 in perspective, that it terminates in a point 25 with convex surfaces which enables it to be introduced into the angularly offset openings of the lamellae (FIG. 5) to realign them by causing them to turn on the one hand and to be radially displaced on the other hand.

On the other hand, it can be seen that, along its two longitudinal edges, the key comprises two profiles complementary to one another. As shown in the drawing, the peaks and the troughs of the profiles are distributed over a certain number of heights, six in the Example shown, the total height of the key in its cross-sections corresponding to the positions of the lamellae being constant and equal to the length of the opening in the lamellae, which enables the lamellae to be exactly centred when the key is introduced. However, to ensure that the lamellae are firmly held on the inclined edges, such as 26, 26', of the key during its introduction into and removal from the lock without having to provide for excessive play, these two profiles are longitudinally staggered to allow for the thickness of the lamellae. FIG. 6 shows in dotted lines one of the lamellae 27 in a position which corresponds to the passage of the key during its introduction and where the inclined edges 26, 26' of the two profiles engage in the opening in this lamellae which, by virtue of the staggering of the two profiles, rests on the inclined edge 26 at the left-hand edge of the narrow side of its opening 30 and on the inclined edge 26' at the righthand edge of the other narrow side of this opening.

It should be noted that, instead of staggering the profiles, the two narrow sides of the openings 30 of the lamellae 14 could be formed with a double camfer 28, 28' (also shown in dotted lines in FIG. 6) having gradients identical with that of the inclined edges of the key, which is equivalent to giving the lamella a zero thickness in its median plane and enabling it to slide with minimum play on the two opposite inclined edges of the two profiles which, in this case, will be entirely complementary over their entire length without any stagger.

The lock according to the invention operates as follows:

Introduction of the key into the openings in the successive lamellae and thin plates results in centring of the lamellae, which unlocks the lock in the axial direction by releasing the lamellae from the slots of the stator.

An axial pressure subsequently applied to the rotor results in its displacement, the effect of which is to bring the lamellae, by axial sliding of their locking lugs in the vertical recesses of the cage, to the level of the slots 4, 5, 6 of the cage, which releases the rotor for rotation.

The rotor is then turned by acting on the key, the effect of which is to cause the locking lugs of the thin plates to enter the slots of the cage instead of the lamellae, which relocks the lock in the axial direction, and in addition this rotation results in actuation of the lock of the bolt by the free ends of the pins.

In order to remove the key, the locking lugs of the thin plates are moved, by turning the key in the opposite direction, into a position where they are opposite their recess, and the rotor, thus unlocked in the axial direction, is left to return under the action of the return spring into its initial position in which the lamellae are opposite the slots of the cage. The key may then be withdrawn, the effect of which is to disalign the lamellae and to engage them in the slots of the cage by a double radial and angular movement.

It will be noted that, in the embodiment described above, the thin plates which comprise three locking lugs arranged at 120° from one another and which cooperate with three corresponding recesses in the cage enable the key to be removed in three different positions, which is particularly advantageous in the case of ignition locks and antitheft locks of motor vehicles which have to have two withdrawal positions: contact breaking in the "garage" position, where the steering remains free, and contact breaking in the "security" position in which the stearing is locked.

Figure 7:
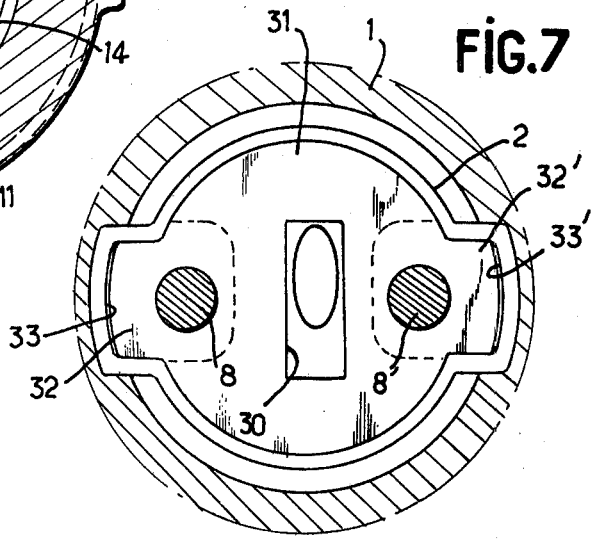
FIG. 7 shows a variant of the rotor.

However, in the case of locks which only require two withdrawal positions, more especially the door locks of motor vehicles, the lock according to the invention may be produced in the manner illustrated in FIG. 7, in which the thin plates 31 comprise only two lugs 32, 32' disposed at 180° from one another and co-operate with two corresponding recesses 33, 33'. In this case, the key may be withdrawn in two positions after half a turn or after a complete turn, as is generally the case in these applications.

According to another variant of the lock according to the invention, instead of forming the slots and recesses for the locking lugs of the thin plates in a cage fitted in the stator, these recesses and slots may be directly produced in the form of vertical grooves and circular recesses in the wall of the stator.

According to another variant, the return spring 13 of the rotor may be omitted because the spring, although facilitating removal of the key, is not indispensible since the lamellae hold the key prisoner as long as they are not opposite the slots of the cage 2, whereas when they are opposite these slots, the effect of removing the key is to displace them into their engagement positions in these slots.

As mentioned earlier on, the lock according to the invention provides for a very large number of combinations by the choice of the number of lamellae and the number of levels of the successive parts of the profiles of the key. Thus, the embodiment illustrated by way of example in FIG. 6 is characterised by the use of five lamellae and six levels represented by the equidistant horizontal lines numbered 0 to 5, which means that the height (constant) of all the sections of the key corresponding to the positions of the lamellae is equal to 6 units. It will be appreciated that, by modifiying a profile of the key so as to change the positions of the lamellae corresponding to their unlocking, it is possible to obtain a different number of combinations equal to the number N of levels raised to the power *n*, *n* being the number of lamellae, i.e., 776 combinations in the embodiment in question. The following Table shows the number of combinations in dependence upon the number N of levels and the number *n* of lamellae:

| Number of lamellae n | Number of levels of the lamellae N | | | |
|---|---|---|---|---|
| | 5 | 6 | 7 | 8 |
| 3 | 125 | 216 | 343 | 512 |
| 4 | 625 | 1296 | 2401 | 4096 |
| 5 | 3125 | 7776 | 16807 | 32768 |
| 6 | 15625 | 46656 | 117649 | 262144 |

Obviously many modifications and variations of the invention as hereinbefore set forth may be made without departing from the spirit and scope thereof. Therefore only such limitations should be imposed as are indicated in the following claims.

What is claimed is:

1. A cylinder lock of the type formed by a stator with a cylindrical bore with a rotor mounted in said bore for rotation from a rest position to at least one operative position, under the action of a profiled flat key, said rotor comprising, in flat recesses a plurality of mutually parallel lamellae said lamellae being perpendicular to the axis of the rotor and displaceable in at least one direction transverse to the axis of the rotor so as to engage at their periphery, when the rotor is in its rest position, in grooves formed in the inner surface of the stator, the lamellae being releasable from said grooves by introduction of the key into openings in said lamellae, the positions of said openings in the successive lamellae corresponding to the profile of said key, release of said lamellae being followed by an axial pressure applied to the rotor by the key against the action of a return spring, releasing elements for locking the rotor in its direction of rotation, which elements contact second elements of complementary shape of the stator to enable the lock to be actuated by rotation of the rotor, one end of the rotor being integral with a control member for operating a bolt, wherein it comprises floating lamellae mounted in such a way that they are able to move freely, but to a limit extent, both radially and angularly, so that, in the rest position, they occupy positions radially and angularly offset relative to one another, and wherein the rotor comprises means for guiding the flat key over its entire introduction path into the barrel without any possibility of radial or lateral displacement, said key having complementary profiles along its opposite edges and a tapered end with convex surfaces enabling it to be introduced into disaligned and angularly offset openings of the lamellae so as to unlock them and to return them to their initial locking position by withdrawal of the key.

2. A lock as claimed in claim 1, wherein the rotor is formed by a stack of parallel thin plates between which are recesses for the lamellae, said plates being separated from one another by intervals exceeding the thickness of a lamella, and being joined together by at least one pin parallel to the axis of the rotor, said thin plates each being provided with a central guide opening having a profile corresponding to the profile of the projection of the cross-section of the key in a transverse plane.

3. A lock as claimed in claim 2, wherein the thin plates are crimped onto the pins by incipient shearing of the pins.

4. A lock as claimed in claim 1, wherein the lamellae are formed by discs each disc having in its periphery a slot for each pin of the rotor, said slots having sufficient depth and width to allow radial displacement and limited angular displacement of the lamellae.

5. A lock as claimed in claim 2, wherein each thin plate has on its periphery at least one projection which, in the rest position, engages in a corresponding recess formed in the stator, to lock the rotor in an operative position, said projection being releasable by said axial pressure applied to the rotor and subsequent rotation bringing the projections into the slots of the stator in place of the lamellae.

6. A lock as claimed in claim 5, wherein the stator is formed by a tube of sheet metal which has been rolled, bent, cut and joined by rolling, comprising longitudinal folds corresponding to the locking projections of the thin plates and circular grooves forming the locking slots of the lamellae.

7. A lock as claimed in claim 5, wherein the stator is formed by a hollow cylinder of several shells comprising longitudinal grooves corresponding to the projections of the thin plates and circular grooves forming the slots of the lamellae.

8. A lock as claimed in claim 1, wherein the two complementary profiles of the key are longitudinally staggered to allow for the thickness of the lamellae.

9. A lock as claimed in claim 1, wherein the narrow sides of the openings of the lamellae have a double symmetrical camfer with a gradient equal to that of the inclined edges of the profiles of the key, these complementary profiles thus not being staggered.

10. A lock as claimed in claim 1 wherein the rotor has a plurality of stages, in each of which the lamellae rest on the thin plates by way of cross pieces whose thickness is such that the distance between two successive lamellae is equal to the interval between the profiles of the key.

* * * * *